US008656536B1

(12) United States Patent
Sorg

(10) Patent No.: US 8,656,536 B1
(45) Date of Patent: Feb. 25, 2014

(54) BREAST LIFT

(75) Inventor: Amanda Gail Sorg, LaPorte, IN (US)

(73) Assignee: Amanda Gail Sorg, LaPorte, IN (US)

( * ) Notice: Subject to any disclaimer, the term of this patent is extended or adjusted under 35 U.S.C. 154(b) by 0 days.

(21) Appl. No.: 13/446,822

(22) Filed: Apr. 13, 2012

Related U.S. Application Data

(60) Provisional application No. 61/474,893, filed on Apr. 13, 2011.

(51) Int. Cl.
*A61G 7/065* (2006.01)
*A61G 15/12* (2006.01)

(52) U.S. Cl.
USPC ..... 5/601; 5/621; 5/630; 378/37; 378/209

(58) Field of Classification Search
USPC ..... 5/601, 621, 623, 630, 646; 128/845, 128/878; 378/37, 209
See application file for complete search history.

(56) References Cited

U.S. PATENT DOCUMENTS

| | | | | | |
|---|---|---|---|---|---|
| 1,516,795 | A * | 11/1924 | Schwarting | ..... | 5/646 |
| 3,032,780 | A * | 5/1962 | Stroup | ..... | 5/630 |
| 3,977,645 | A * | 8/1976 | Deely | ..... | 248/484 |
| 5,281,001 | A * | 1/1994 | Bergsten et al. | ..... | 297/411.24 |
| 6,622,324 | B2 * | 9/2003 | VanSteenburg et al. | ..... | 5/621 |
| 6,629,944 | B2 * | 10/2003 | Smart | ..... | 602/36 |
| 8,256,047 | B2 * | 9/2012 | Klemm et al. | ..... | 5/621 |
| 8,322,342 | B2 * | 12/2012 | Soto et al. | ..... | 128/845 |

* cited by examiner

*Primary Examiner* — Michael Trettel
(74) *Attorney, Agent, or Firm* — Botkin & Hall, LLP

(57) ABSTRACT

A device for supporting a breast during treatment. The device includes a support arm having one or more indexed joints for repeatably positioning the device relative a patient's breast. The device includes a scoop for wedging against the patient's breast for forming the breast to a preferred shape during treatment.

17 Claims, 2 Drawing Sheets

22
14
28
42
30
34
58
32
46
62
44
20
38
62
70
80
72
78
18
82
74
66
68
10
64
98
92
106
86
94
16
90
88
12

62
72
78
76
64

114
22
14
112
28
106

12
66
62
72
64
86
92
16
90
68
76
88
98

BREAST LIFT

CROSS REFERENCE TO RELATED APPLICATION

This application claims the benefit of U.S. Provisional Application No. 61/474,893, filed Apr. 13, 2011, the disclosure of which is hereby incorporated by reference.

BACKGROUND OF THE INVENTION

Medical treatment of the breast, such as radiation treatment, can be effective in treating cancers and other ailments. For such treatment to be most effective, the treatment must be targeted at the affected tissue in such a way that damage to surrounding tissue is minimized. Such targeting is more difficult on patients who have large or pendulous breasts. One common side-effect of radiation treatment of the breast is irritation to the skin in the area surrounding the affected tissue. Such treatment can also result in an increased dose of treatment to the lungs. Additionally, in some cases such treatment, when applied to the left breast, may need to be reduced to prevent the dose affecting the heart, and as a result an insufficient dose is applied.

In order to allow for proper treatment of a large or pendulous breast, it is often necessary to provide support to the breast to bring the breast to a more bulbous shape. One way to form the breast to a bulbous shape is to treat the patient in a prone position (such as lying face-down). The downside of treating patients in the prone position is that many patients who require such treatment are unable to maneuver themselves onto a table and into the prone position due to their increased age or other physical limitations. Another way to form the breast to a bulbous shape is to use an external support device to shape the breast into an ideal shape. In many cases, such prior art external support devices are generally crude homemade instruments constructed from objects on hand in the treating office, such as plastic film, or tape.

Any external support device used during such treatments needs to be able to return the breast to a repeatable shape during each of successive treatments. As such, the prior art "homemade" solutions are inadequate, as they do not lend themselves to consistent and reproducible shaping of the breast. In the common case, a patient will need to receive multiple treatments over a series of visits, and the treatments need to be consistent. As such, the positioning of the patient, and the positioning of the breast needs to be accurately reproducible from visit to visit so as to provide consistent and repeatable dosing to the affected tissue while minimizing dosing to unaffected tissue.

As such, an improved external support device for breasts is needed.

SUMMARY OF THE INVENTION

The present disclosure describes a breast support device for shaping and supporting a breast during treatment. The breast support of the present disclosure includes a scoop which contacts and shapes the breast. The scoop is carried by a support arm. The support arm is secured to an examination table upon which the patient lays during treatment. The support arm includes one or more joints, which joints allow the scoop to be positioned at a desired location and angle relative the breast. The joints of the support arm are indexed and include markings which allow each joint to be independently "dialed in" to a specific position such that the breast support may be precisely repositioned to an exact orientation relative the breast when a patient is treated on successive occasions.

BRIEF DESCRIPTION OF THE DRAWINGS

A preferred embodiment of this invention has been chosen wherein.

DESCRIPTION OF THE PREFERRED EMBODIMENT

Figures 2, 3, 4, 5:
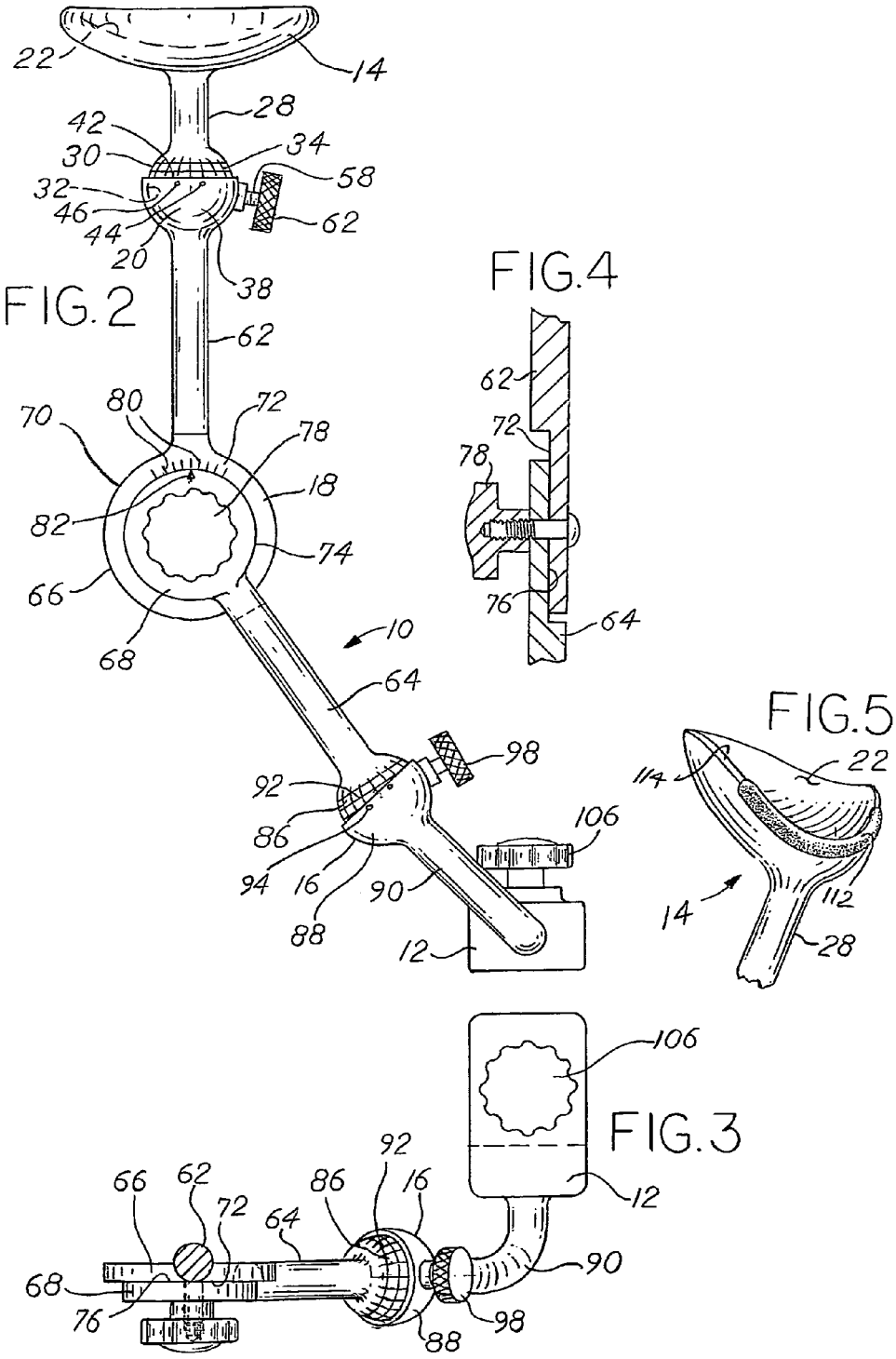
FIG. 2 is a side view of one embodiment of the support arm.
FIG. 3 is a top view of the support arm of FIG. 2 with scoop cut away.
FIG. 4 is a cross-section of the elbow of the support arm of FIG. 2.
FIG. 5 is a perspective view of one embodiment of the scoop.

The present disclosure describes a support arm 10 extending between a mount 12 and a scoop 14 as shown in FIG. 2. Support arm 10 includes multiple points of articulation, including a lower joint 16, an elbow 18 and an upper joint 20. Each of joints 16, 18, 20 serve to allow hinged movement of support arm 10 such that scoop 14 may be positioned at a desired spatial orientation.

Figure 1:
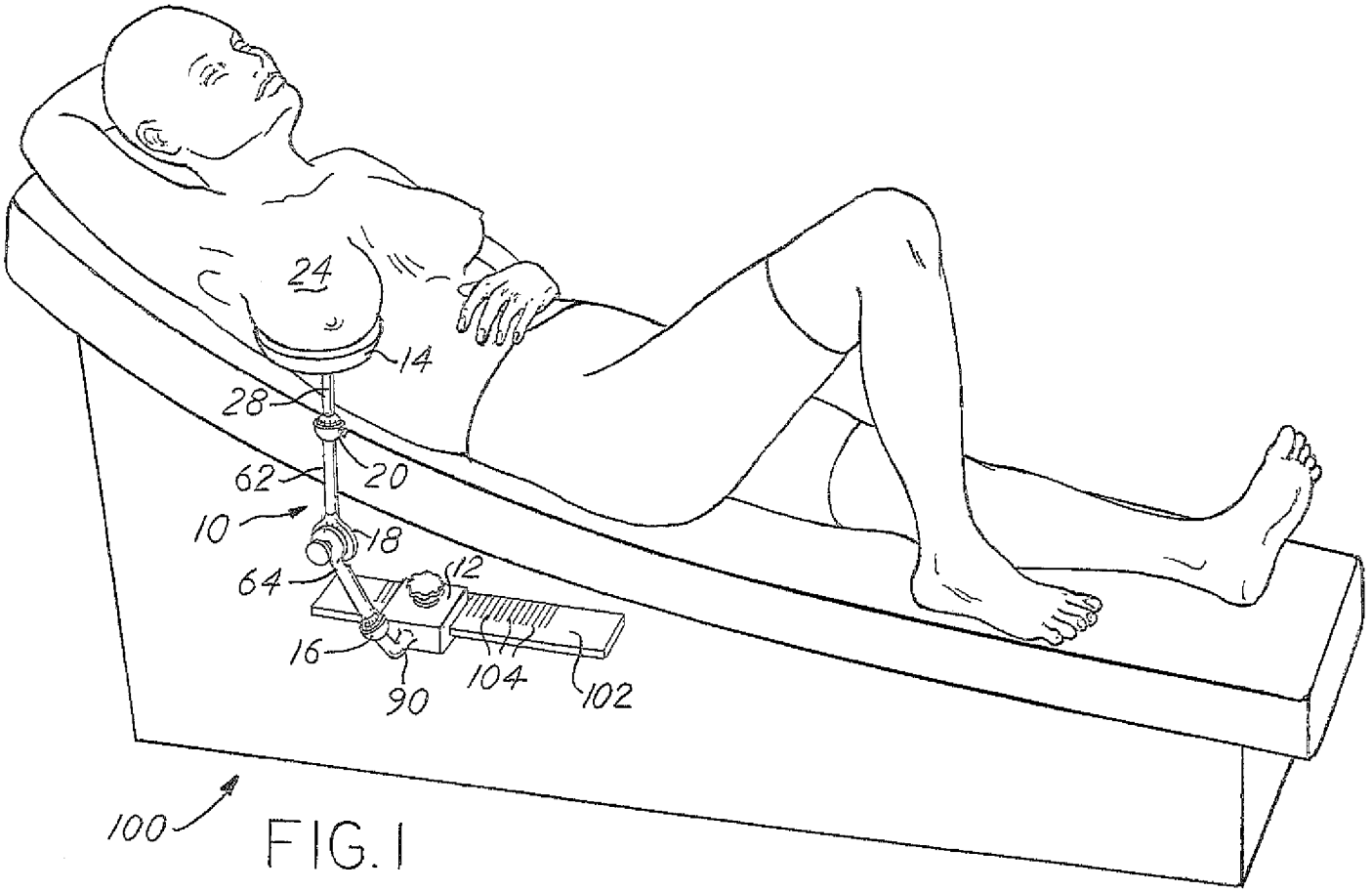
FIG. 1 is a perspective view of the examination table with support arm attached.

Scoop 14 defines a support surface 22. Support surface 22 is bowl-shaped and forms the upper surface of scoop 14. Support surface 22 is shaped such that it can be pressed against a breast 24 of a patient 26, as shown in FIG. 1, such that support surface 22 supports and shapes breast 24 to a shape suitable for receiving a medical treatment, such as radiation.

Scoop 14 is carried on a scoop arm 28. Scoop arm 28 defines an upper portion of support arm 10. Scoop arm 28 extends between scoop 14 and upper joint 20. Upper joint 20 is defined by a ball 30 and socket 32. In one embodiment, socket 32 is a ball-shaped recess formed in scoop 14. In another embodiment, as shown in FIG. 2, socket 32 is formed separately from scoop 14. Ball 30 is rotatable in socket 32 such that scoop 14 may be positioned in a variety of spatial relationships relative to support arm 10 as needed to properly support breast 24. Ball 30 includes markings, such as grid lines 34, for repeatably orienting scoop 14. In the preferred embodiment grid lines 34 are marked as latitude and longitude lines on ball 30. Socket 32 includes an inner surface 36 (not shown) which contacts ball 30. Socket 32 includes an outer surface 38 which includes markings 40 which serve to orient ball 30 in a repeatable spatial orientation with socket 32. In the preferred embodiment, markings 40 are defined by a pair of spaced dots 44, 46 proximate an edge 42 of socket 32. Markings 40 are repeatably alignable to a user-defined position 56 (not shown) on grid lines 34 by moving ball 30 relative socket 32 until first dot 44 is proximate a first latitude reading 48 (not shown) and a first longitude reading 50 (not shown) and second dot 46 is proximate a second latitude reading 52 (not shown) and a second longitude reading 54 (not shown). Ball 30 is rotatable relative socket 32 in three dimensions, meaning it is rotatable along an x, y, and z axis which passes through the center of ball 30. Ball is retained at position 56 by tightening a fastener 58 which is carried on socket 32. Fastener 58 is preferably formed having a knob 60 which, when rotated, advances or withdraws a threaded fastener member 58 from ball 30, such that when fastener 58 is tightened against ball 30, ball 30 will be held at position 56 relative socket 32. In the preferred embodiment scoop arm 28 is joined to scoop 14 on one end and ball 30 on the other end. In an alternative embodiment scoop arm 28 is joined to scoop 14 on one end and to socket 32 on the other end.

Upper joint 20 is joined on one side to scoop arm 28 and is joined on another side to an upper arm 62. In the preferred embodiment upper arm 62 is joined to socket 32 of upper joint 20. Upper arm 62 extends between upper joint 20 on one end and elbow 18 on the other end.

Elbow 18 is a rotatable joint which allows rotation of upper arm 62 relative a lower arm 64 as shown in FIGS. 2 and 4. In the preferred embodiment, elbow 18 allows rotation of upper arm 62 relative lower arm 64 in a single plane. In an alternative embodiment, elbow 18 could be replaced by a different type of joint, such as a ball and socket type joint as described above. Elbow 18 is preferably formed from a pair of plates, an upper arm plate 66 and a lower arm plate 68. Upper arm plate 66 is joined to upper arm 62. Lower arm plate 68 is joined to lower arm 64. Upper arm plate 66 is defined by a generally round outer edge 70 and a flat mating surface 72. Lower arm plate 68 is defined by a generally round outer edge 74 and a flat mating surface 76. Lower arm plate 68 is held against upper arm plate 66 such that mating surface 72 contacts mating surface 76. A fastener 78 serves as the point of rotation between lower arm plate 68 and upper arm plate 66. Fastener 78 may be tightened to hold upper arm plate 66 in a fixed position relative lower arm plate 68. Alternatively, fastener 78 may be loosened to allow upper arm plate 66 to rotate relative lower arm plate 68, in this way elbow 18 is rotatable to allow upper arm 62 and lower arm 64 to be aligned in a desired way to aid in positioning scoop 14 against breast 24. Upper arm plate 66 includes markings 80 and lower arm plate 68 includes marking 82, such that upper arm plate is rotatable relative lower arm plate to a position 84 (not shown) defined by a user. Markings 80 on upper arm plate 66 are preferably located on mating surface 72 at radially-spaced intervals, such that as lower arm plate 68 is rotated to position 84, marking 82 will be proximate one of markings 80, such that when fastener 78 is tightened, elbow 18 remains in that orientation. Position 84 is repeatable by realigning markings 80 and 82 at the user-defined position.

Lower arm 64 is joined at one end to elbow 18 and at the other end to lower joint 16. Lower joint 16 is preferably formed from a ball 86 and a socket 88 having similar construction as the ball and socket joint described above. Lower joint 16 is joined to both lower arm 64 and a clamp arm 90. In the preferred embodiment lower arm 64 is joined to ball 86 and clamp arm 90 is joined to socket 88, such that lower arm 64 is rotatable relative clamp arm 90. In an alternative embodiment, lower arm 64 is joined to socket 88 and clamp arm 90 is joined to ball 86. Ball 86 includes markings 92, such as latitude and longitude lines, similar to those described above, that can be repeatably located to markings 94 on socket 88, such that lower arm 64 and clamp arm 90 may be repeatably oriented at a user-defined position 96 (not shown). A fastener 98 is carried by socket 88 and serves to brace ball 86 at position 96 when fastener 98 is tightened.

Clamp arm 90 is joined at one end to lower joint 16 and is joined at another end to mount 12. Mount 12 is a clamp, or similar device suitable for mounting support arm 10 to a examination table 100 as shown in FIG. 1. The examination table of FIG. 1 is merely illustrative of one table suitable for use with the support arm of the present disclosure. It is contemplated that support arm 10 is compatible with other tables or examination devices as are known in the art. Any reference to examination 10 should not be seen as limiting the application of support arm 10. Instead, it is understood that support arm 10 is mounted to any structural support suitable for maintaining scoop 14 is a fixed position when wedged against a patient's breast.

In one embodiment examination table 100 includes a flange 102 extending from a side of the table, with flange 102 suitable for accepting mount 12. Mount 12 is preferably positioned at a lateral position between the patient's breast and feet, preferably proximate the patient's navel. Flange 102 preferably extends for some length of table 100, such that mount 12 may be secured at varying positions along flange 102. In one embodiment, flange 102 includes markings 104 such that mount 12 may be moved to an indexed position along flange 102, with the position identifiable by markings 104. Mount 12 preferably includes a fastener 106 suitable for fastening mount 12 at a desired position on table 100. In one embodiment, mount 12 is removably attached to table 100, such that it is laterally movable to different positions relative table 100. In another embodiment mount 12 is fixedly attached to table 100, such that it is held at a fixed position on table 100.

As described herein, each of joints 16, 18, 20 and flange 102 include markings for reproducibly orienting scoop 14. These markings serve as an index and include identifiers, such as numbers, letters or other symbols, such that a given orientation of a joint will be identifiable by some combination of symbols. In this way, a user can orient scoop 14 against a patient's breast and then tighten each of the respective fasteners. With the fasteners thus tightened, the user records the indexed position of each joint by noting the symbols on each joint. In this way, when the patient returns for a follow-up visit, scoop 14 is positioned in the precise spatial arrangement as the previous visit by returning each joint to the previously-recorded indexed position, thereby allowing precise and repeatable application of a treatment or therapy on subsequent visits.

In one embodiment of the present invention, each of joints 16, 18, 20 and flange 102 include detents such that the respective joints/flange are positionable at discrete positions, which positions are reproducible by noting the respective markings. In the case of the ball and socket joints 16, 20, the ball includes a series of raised or lowered dimples, similar to the surface of a golf ball, and the socket includes matching bosses or recesses for mating with the ball, such that as the ball is rotated within the socket the dimples and bosses/recesses mate at discrete positions and can then be clamped in place by the respective fastener. Elbow joint 18 may include radial detents which allow the elbow to be held at discrete angles when the fastener is tightened. Flange 102 also includes a series of detents extending perpendicularly to the length of the flange, which detents allow the clamp to be held specific positions along the flange.

Support arm 10 is designed with rigid parts, such that when joints 16, 18, 20 are locked by the respective fasteners, scoop 14 will provide sufficient force to deform and hold breast 24 in a desired shape. Preferably, scoop 14 is positioned such that breast 24 is held in a bulbous shape by being wedged against the base and side of the breast.

In an alternative embodiment (not shown), one or both of upper arm 62 or lower arm 64 is formed such that the length is extendible. In such embodiment, upper arm 62 is formed having an inner arm and a sleeve, with the inner arm carried within the sleeve in a telescoping arrangement. The inner arm is movable within sleeve 110 so as to lengthen or shorten upper arm 62. The inner arm includes a series of markings extending axially along the inner arm, which markings are used to repeatably position upper arm 62 at a user-defined position. A fastener locks inner arm 108 and the sleeve at the desired position. A corresponding inner arm, sleeve, marking, and fastener configuration could be included for one or both of upper arm 62 and lower arm 64.

Scoop 14 is preferably shaped to form breast 24 to a bulbous shape. FIG. 5 shows a preferred shape of scoop 14. A shown here, scoop 14 includes a lip 114 which forms the upper edge or rim of the scoop. In this embodiment, scoop 14 includes a pad 112 which covers a portion of lip 114 of scoop 14. Lip 114 is cut-away, or recessed, where contacted by pad 112. In this way, scoop 14 is positioned against breast 24 such that pad 112 contacts the patient near where the breast meets the chest proximate the arm of the patient, and support surface 22 forms the breast into the desired shape. Pad 112 is optional, but is provided in this embodiment to provide comfort to the patient.

What is claimed is:

1. A breast support comprising:

a support arm extending between a mount at one end and a scoop at another end; said scoop joined to said support arm; said scoop having a bowl-shaped support surface; said mount joined to said support arm opposite said scoop; said mount anchored to a structural support; said support arm including an indexed joint for reproducibly orienting said scoop, wherein said mount is a clamp for removably mounting said support arm to said structural support, wherein said support arm includes a first indexed joint, a second indexed joint and a third indexed joint.

2. The breast support of claim 1, and said support arm includes a scoop arm spanning between said first indexed joint and said scoop.

3. The breast support of claim 2, and said support arm defined by a clamp arm spanning between said third indexed joint and said mount.

4. The breast support of claim 3, and said support arm is defined by an upper arm spanning between said first indexed joint and said second indexed joint.

5. The breast support of claim 4, and said support arm is defined by a lower arm spanning between said second indexed joint and said third indexed joint.

6. The breast support of claim 1, wherein said first indexed joint is a ball-and-socket joint.

7. The breast support of claim 6, wherein said ball includes markings in the nature of latitude and longitude lines.

8. The breast support of claim 7, wherein said first indexed joint includes a series of bosses and recesses for positioning said first indexed joint at discrete positions.

9. The breast support of claim 1, wherein said third indexed joint is a ball-and-socket joint.

10. The breast support of claim 9, wherein said third indexed joint includes a series of bosses and recesses for positioning said third indexed joint at discrete positions.

11. The breast support of claim 1, wherein said second indexed joint is an elbow joint.

12. The breast support of claim 11, wherein said second indexed joint includes a series of detents for positioning said second indexed joint at discrete positions.

13. A breast support comprising:

a support arm extending between a mount at one end and a scoop at another end; said scoop joined to said support arm; said scoop having a bowl-shaped support surface; said mount joined to said support arm opposite said scoop; said mount anchored to a structural support; said support arm including an indexed joint for reproducibly orienting said scoop, wherein said indexed joint includes detents for positioning said joint at discrete positions.

14. A breast support comprising:

a support arm extending between a clamp at one end and a scoop at another end; said scoop joined to said support arm; said scoop having a bowl-shaped support surface; said clamp joined to said support arm opposite said scoop; said clamp anchorable to an examination table; said support arm including an indexed joint for reproducibly orienting said scoop; said indexed joint having markings for reproducibly orienting said scoop; said indexed joint having detents for positioning said joint at discrete positions.

15. The breast support of claim 14, wherein said support arm includes a first indexed joint, a second indexed joint and a third indexed joint.

16. The breast support of claim 15, wherein said first indexed joint and said third indexed joint are ball-and-socket joints.

17. The breast support of claim 16, wherein said second indexed joint is an elbow joint.

* * * * *